US005673236A

United States Patent [19]

Barger

[11] Patent Number: 5,673,236

[45] Date of Patent: Sep. 30, 1997

[54] UNDERWATER ACOUSTIC PROJECTOR

[75] Inventor: James E. Barger, Winchester, Mass.

[73] Assignee: BBN Corporation, Cambridge, Mass.

[21] Appl. No.: 681,706

[22] Filed: Jul. 2, 1996

Related U.S. Application Data

[63] Continuation-in-part of Ser. No. 390,638, Feb. 17, 1995, abandoned.

[51] Int. Cl.[6] ..... H04R 17/00

[52] U.S. Cl. ..... 367/157; 367/163; 367/174; 310/337

[58] Field of Search ..... 367/153, 155, 367/163, 174, 157, 158; 310/337

[56] References Cited

U.S. PATENT DOCUMENTS

| | | | |
|---|---|---|---|
| 2,405,472 | 8/1946 | Tuttle | 367/174 |
| 2,406,792 | 9/1946 | Benioff | 367/163 |
| 2,589,135 | 3/1952 | Rafuse | 367/163 |
| 2,906,991 | 9/1959 | Camp | 367/157 |
| 3,150,347 | 9/1964 | Hanish | 367/163 |
| 3,274,537 | 9/1966 | Toulis | 367/163 |
| 3,538,494 | 11/1970 | Erickson | 367/174 |
| 3,964,014 | 6/1976 | Tehon | 367/163 |
| 4,364,117 | 12/1982 | Snow | 367/152 |
| 4,706,230 | 11/1987 | Inoue et al. | 367/174 |
| 4,735,096 | 4/1988 | Dorr | 73/662 |
| 4,805,157 | 2/1989 | Ricketts | 367/114 |
| 4,845,688 | 7/1989 | Butler | 367/174 |
| 4,972,390 | 11/1990 | Pagliarini, Jr. | 367/158 |
| 5,166,907 | 11/1992 | Newnham et al. | 367/157 |
| 5,204,844 | 4/1993 | Erickson | 367/163 |
| 5,237,543 | 8/1993 | Erickson et al. | 367/157 |
| 5,287,332 | 2/1994 | Lea | 367/153 |

*Primary Examiner*—J. Woodrow Eldred
*Attorney, Agent, or Firm*—Henry D. Pahl, Jr.

[57] ABSTRACT

The underwater sound projector disclosed herein employs, as radiating surfaces or pistons, stiff, lightweight panels whose mass is substantially less than the inertial component of the radiation impedance over the operating frequency range. The panels are driven in opposition by a plurality of linear actuators, e.g., piezoelectric stacks, distributed essentially uniformly over the panels so that each stack drives an essentially equal area of the panel and flexing of the panel is avoided. The compliance reactance of the actuators is made to cancel the inertial reactance of the radiation impedance at all frequencies within an at least decade-wide frequency band. In this way, operation, similar to resonance with its high efficiency, is achieved continuously over a wide frequency band.

16 Claims, 3 Drawing Sheets

UNDERWATER ACOUSTIC PROJECTOR

This application is a continuation-in-part of application Ser. No. 08/390,638 filed on Feb. 17, 1995, now abandoned.

BACKGROUND OF THE INVENTION

The present invention relates to an underwater sound projector and more particularly to such a projector which operates efficiently over a wide frequency range.

For towed array, active sonar systems such as are employed for anti-submarine warfare (ASW), it is highly desirable that the transducers used in the array be operable over a wide band of frequencies with high efficiency. It is also desirable that the transducers have a physical configuration that lends itself to underwater towing with low drag.

While various expedients have been proposed for broadening the response of some transducer designs, most prior art transducers, in fact, operate in a mode which involves a fixed-frequency mechanical resonance of the transducer itself, with the resonance frequency slightly modified by the radiation impedance. Examples of such transducers are the so called bending moment transducers of the type disclosed in U.S. Pat. Nos. 3,150,347, 4,972,390 and 5,204,844. Various electromagnetic low frequency transducers have been devised which have fixed-frequency resonances with relatively broad responses, but these have typically entailed bulky and heavy physical configurations.

Among the several objects of the present invention may be noted the provision of an underwater sound projector which is operable efficiently over a wide range of frequency; the provision of such a transducer which is efficiently operable over a range of frequencies spanning three octaves; the provision of such a projector which provides a configuration suited for underwater towing; the provision of such a projector which provides desirable directivity characteristics; the provision of such a projector that can be neutrally buoyant; the provision of such a transducer which is highly reliable and which is of relatively simple and inexpensive construction. Other objects and features will be in part apparent and in part pointed out hereinafter.

SUMMARY OF THE INVENTION

The underwater sound projector of the present invention is adapted for radiating sound energy over a range of frequencies into a body of water in which the projector is immersed. A pair of stiff lightweight plates are employed as complimentary, aligned and spaced apart pistons with their peripheries being flexibly sealed to exclude water from the space between them. A plurality of linear actuators, e.g., piezoelectric stacks, are provided between the pistons for driving them in opposition thereby to radiate sound energy into the body of the water, the inertial component of the radiation impedance being substantially greater than the mass of the panels over the range of frequencies of interest.

In accordance with one aspect of the present invention, the compliance of the linear actuator is such that $$C_m\alpha=1$$

where $C_m$ is the combined mechanical compliance of the actuators and $\alpha$ is the product circular frequency times inertial component of the radiation impedance, over the frequency range where $\alpha$ is substantially constant. One method of making the pistons is to fabricate them as honeycomb cored panels. Another method is to employ an aluminum plate grooved to allow individual sections to align with respective actuators.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
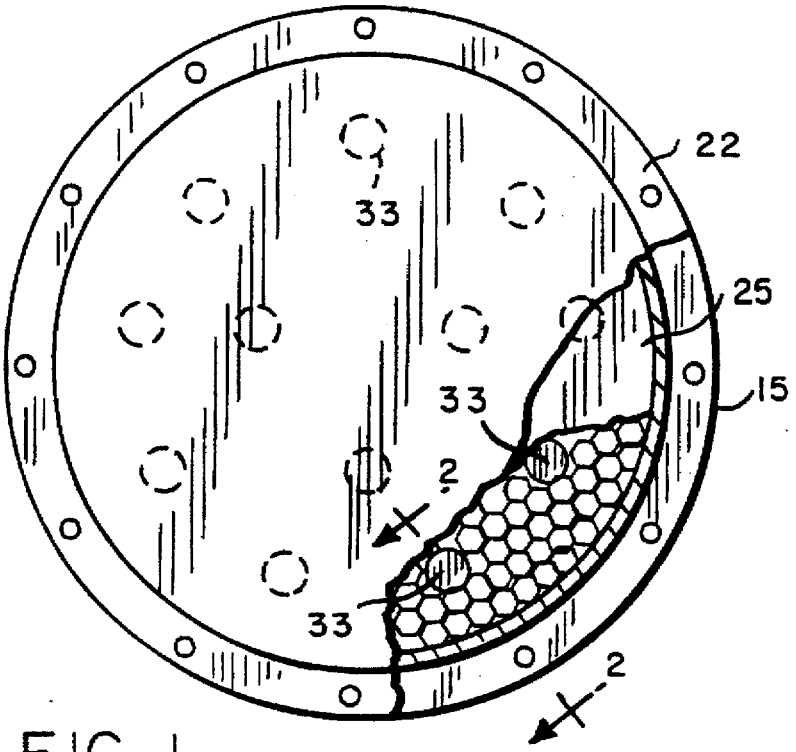
FIG. 1 is a face view of a circular underwater sound projector constructed in accordance with the present invention, parts being broken away.
Figure 2:
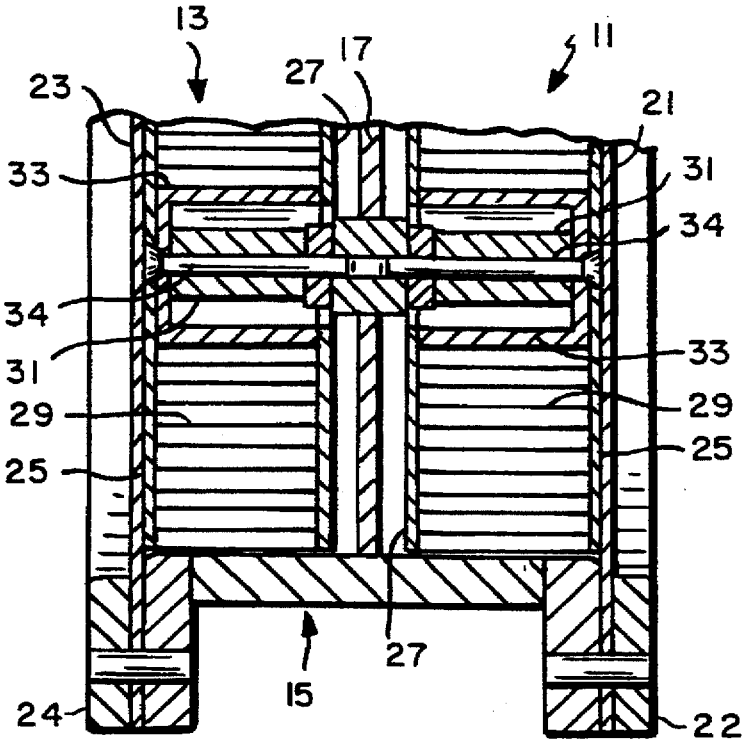
FIG. 2 is a sectional view taken substantially on the line 2—2 of FIG. 1.

Referring now to FIGS. 1 and 2, the projector illustrated there employs a pair of pistons 11 and 13 which are set into corresponding recesses in a circular frame 15. While frame 15 is shown as including a central web 17, this web may be omitted in some arrangements since the pistons are driven in opposition as described hereinafter. The pistons may be described as complimentary, aligned and spaced apart. Flexible diaphragm seals 21 and 23 retained by clamp rings 22 and 24 are provided for flexibly sealing the piston panels so as to exclude water from the space between them. As will be understood, sliding or O-ring seals might also be employed.

In accordance with one aspect of the present invention, the pistons 11 and 13 are constructed as relatively stiff, lightweight plates. In the embodiment of FIGS. 1 and 2, the plates are made up of honeycomb cored panels. As may be seen in FIG. 2, the panels comprise outer and inner skins of stainless steel, designated by reference characters 25 and 27 respectively, separated by an aluminum honeycomb 29. As is understood by those skilled in the art, such a construction is highly resistant to bending since the skin panels take up the tension and compression forces of bending while the honeycomb maintains the desired spacing between the skins.

The pistons 11 and 13 are driven in opposition by a plurality of piezoelectric stacks 31 which are distributed essentially uniformly over the panels so that each stack drives an essentially equal area of the panel. Magnetostrictive or other types of linear actuators might also be used. Combined with the inherent stiffness of the panels, this distributed arrangement essentially eliminates flexing of the panels. In the illustrated embodiment, the stacks 31 work against the central web 17 but, as will be understood, in other arrangements where the web is omitted, a longer stack might be employed where each piston is, in effect, driven with respect to the opposite piston.

As illustrated, the stacks 31 are set into recesses in the piston panels formed by flanged cylindrical sockets 33 and are clamped by through bolts 34. These sockets facilitate the coupling of driving forces from each stack to the corresponding local area of the honeycomb panel while maintaining the panel's structural integrity. These sockets also allow the two pistons 11 and 13 to be closely spaced, thereby making the overall projector thinner. As described in greater detail hereinafter, the piezoelectric stacks 31 are configured to provide a compliance or spring constant which is matched to the change in the inertial component of the radiation impedance with frequency over the operating frequency range.

Figure 3:
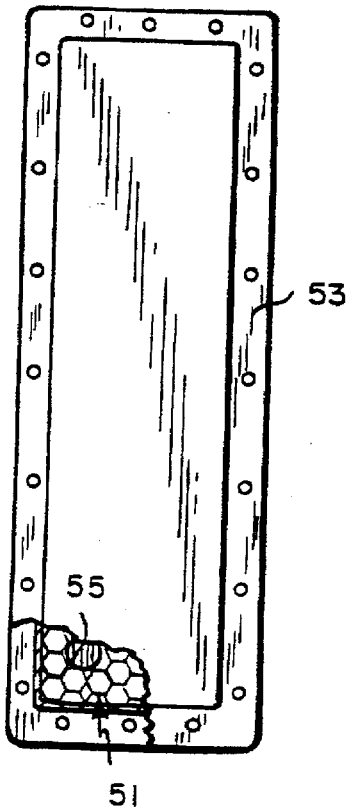
FIG. 3 is a face view of a rectangular underwater sound projector constructed in accordance with the present invention, again with parts being broken away.

FIG. 3 illustrates a rectangular projector configuration which is particularly well adapted for inclusion as a transducer in a towed underwater array. For such an application, the rectangular pistons 51, set in a frame 53, may, for example, have a height of 5 meters and a width of 1 meter. Such a configuration gives significant directivity in the vertical dimension, which is useful in avoiding ocean bottom reflections, while being essentially omni-directional in azimuth over the working frequency range of 400 Hz to 3000 kHz. Again, piezoelectric stacks 55 are distributed essentially uniformly over the pistons so that each stack drives an essentially equal area of the honeycomb panel. Arrangement of the stacks within recessed flanged cups is essentially the same as in the construction of FIGS. 1 and 2.

As will be understood, the piston construction employed in the preferred practice of the invention inherently provides a relatively thin panel, so that the transducer as a whole is relatively thin, e.g., 0.17 meters. Thus, the transducer itself provides a good approximation of a fin, which can be relatively easily towed, rather than having to be fit into a flooded tow body as is the case with most prior art projectors intended for the same applications.

Figure 4:
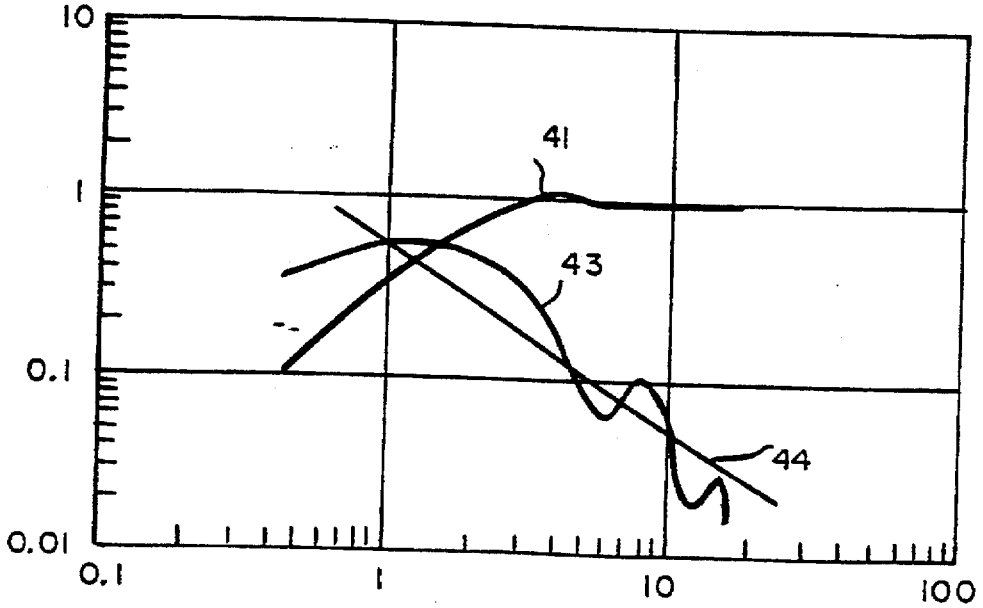
FIG. 4 is a graph illustrating calculated normalized radiation impedance for a projector of the type illustrated in the FIG. 3.

FIG. 4 is a graph illustrating calculated and normalized radiation impedance for a 1 meter by 5 meter radiating piston such as is employed in the projector illustrated in FIG. 3. The resistive component of the radiation impedance is represented by the curve 41 while the reactive or inertial component is represented by the curve 43. The abscissa values are the products of acoustical wave number and piston width. As may be seen, the inertial component drops off significantly after a maximum at about 1.5, corresponding to 360 hertz. While there are various discontinuities in the behavior of the reactive component, the general behavior can be characterized as a slope (reference character 44) indicating that the radiation reactance decreases inversely with increasing frequency. The asymptotic frequency dependence of the reactive component can be expressed as follows:

$$I_m(Z_{rad}) \rightarrow \frac{8\rho c^2 ab}{\pi\omega(a\&b)} = \frac{\alpha}{\omega}$$

where a and b represent the projector width and height, ρ represents the mass density of water and c represents the speed of sound in water.

In accordance with an important aspect of the present invention, the compliance reactance of the piezoelectric stacks is selected to cancel the mass reactance of the radiation reactance such that $$C_m\alpha=1$$

Where $C_m$ is the combined mechanical compliance of the actuators and α is as defined above.

With this matching of compliance or spring constant with the inertial component of radiation impedance, a behavior essentially equivalent to resonance in terms of transduction efficiency is obtained over a wide range of frequencies. This can be explained in the following manner.

In general, resonant behavior occurs when the reactive impedance in the system is equal to zero.

$$I_m(Z_{rad})+I_m(Z_{mech})=0$$

$Z_{mech}$ is the mechanical impedance of the pistons and the actuators. The piston mass is $M_p$.

$$I_m(Z_{rad})+\omega M_p-1/\omega C_m=0$$

and further if the radiation reactance is in the range described above:

$$\alpha/\omega+\omega M_p-1/\omega C_m=0$$

However, if the mass of the piston (Mp) is made substantially less than the inertial component of the radiation reactance in the frequency range of interest, the corresponding term in the above equation drops out, and there remains.

$$\alpha C_m=1$$

so that resonant type behavior becomes pervasive over the frequency range. The limit on this behavior is when, at higher frequencies, the mass reactance of the projector exceeds the radiation mass, i.e., the inertial component of the radiation reactance.

However, as will be understood from the foregoing explanation and the graph of FIG. 4, this condition of pervasive resonance can exist over a quite substantial frequency range, e. g. over three octaves. Over this range, the projector will exhibit relatively high efficiency in the conversion of electrical energy to acoustic energy. Not only is this useful range considered to be substantially greater than that available with prior art arrangements, the physical configuration of the projector is well-suited for underwater towing as described previously.

While it is desirable that the entire effective face area of the projector move in controlled fashion, the use of a completely unbending diaphragm in practice causes some difficulty in establishing equal loading of a multiplicity of piezoelectric stacks. Unequal loading may, in turn, cause stress waves across the width of the diaphragm since its width can be large as compared to the wavelength of the projected acoustic signal.

Figure 5:
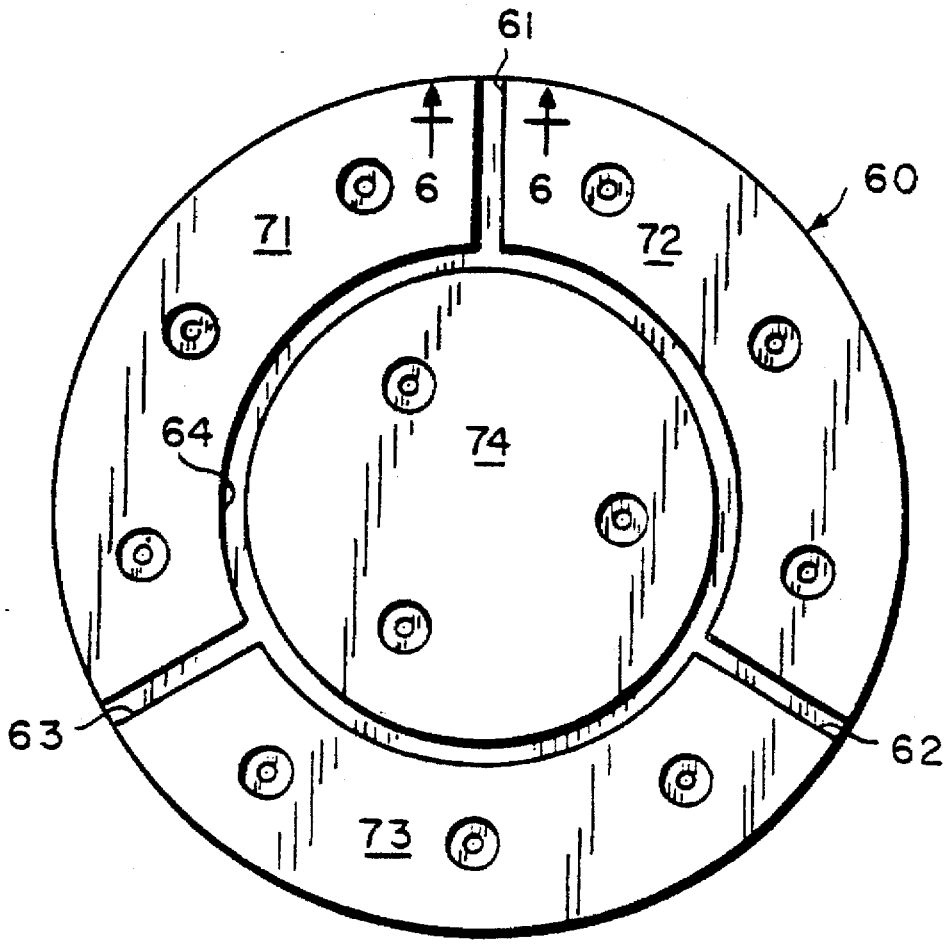
FIG. 5 is a back face view of a piston employed in another embodiment of the present invention.
Figure 6:
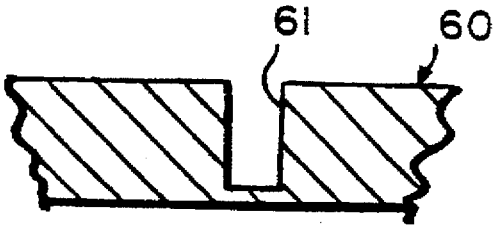
FIG. 6 is a sectional view, taken substantially on the line 6—6 of FIG. 5.

The embodiment of FIGS. 5 and 6 employs the same arrangement of piezoelectric stacks as the embodiment of FIGS. 1 and 2. However, rather than a honeycomb piston, the piston is constructed as an aluminum plate 60 which is divided by milled slots 61–64 into four regions 71–74 which are of equal area and each of which encompasses three of the piezoelectric stacks. The central region is circular and the other three regions are arcuate,each extending one third of the region around the central region. The milled slots 61–64 extend most of the way through the aluminum plate 60 so that the remaining thickness provides some flexibility allowing a small relative movement between the different regions. Accordingly, as the through bolts 34 draw the aluminum plate down against the piezoelectric stacks, each region is to some extent free to line itself with the heights of its three respective piezoelectric stacks so that equal loading of each stack can be provided.

Although the resultant overall projector may, in one sense, be regarded as an array of four pistons, the advantages of the present invention are obtained so log as the relationship $$C_m=1$$

is maintained. In this regard, it should be understood that the inertial component of the radiation impedance is based on the overall area of the projector rather than the area of each region of the piston. In similar fashion, it can be understood that the projector can be constructed of a plurality of separate elements with their edges in close proximity, again observing the desired relationship and determining inertial component of the radiation impedance based on the overall area of the array.

While the use of a solid aluminum plate lowers the high frequency response somewhat since the mass of the piston begins to approximate the inertial component of the radiation impedance at a lower frequency, it is still possible to achieve very wide range response, i.e., over several octaves.

A further alternative for the construction of the piston for use in a projector in accordance with the present invention is to construct the piston of a high strength composite, e.g., using carbon fibers so as to achieve high strength with relatively low mass without having the difficulties attendant with localized points of attachment in a honeycomb structure.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. An underwater sound projector for radiating sound energy over a range of frequencies F1 to F2 into a body of water into which the projector is immersed, said projector comprising:

a pair of complementary, aligned and spaced-apart panels constructed as lightweight plates;

means for flexibly sealing the peripheries of said panels to exclude water from the space between them;

a plurality of actuators between said panels for driving said panels in opposition, thereby to radiate sound energy into said body of water, the inertial component of the radiation impedance being substantially greater than the mass of the panels over the frequency range F1–F2, the compliance of the actuators being such that $$C_m\alpha=1$$

where $\alpha$ is the product of angular frequency and the radiation reactance of water within the range F1–F2 and $C_m$ is the compliance of the actuators.

2. An underwater sound projector as set forth in claim 1 wherein said linear actuators are distributed essentially uniformly over said panels so that each actuator drives an essentially equal area of the panel thereby to minimize flexing of the panel.

3. An underwater sound projector as set forth in claim 1 wherein said linear actuators are piezoelectric stacks.

4. An underwater sound projector as set forth in claim 1 wherein said panels are constructed as honeycomb cored plates.

5. An underwater sound projector as set forth in claim 1 wherein said panels are constructed of aluminum plates.

6. An underwater sound projector as set forth in claim 5 wherein each of said plates comprises a plurality of equal area sections joined by thin webs.

7. An underwater sound projector as set forth in claim 6 wherein each of said sections is driven by three of said actuators.

8. An underwater sound projector for radiating a substantially constant amount of sound energy over a range of frequency F1 to F2 into a body of water into which the projector is immersed, said projector comprising:

a pair of complementary, aligned and space-apart panels as stiff, lightweight plates which resist bending over said range of frequencies;

means for flexibly sealing the peripheries of said panels to exclude water from the space between them;

a plurality of linear actuators between said panels for driving said panels in opposition, said actuators being distributed essentially uniformly over the panels so that each stack drives an essentially equal area of the panel and there is essentially no flexing of the panel, thereby to radiate sound energy into said body of water, the compliance of the actuators being such that $$C_m\alpha=1$$

where $\alpha$ is the product of angular frequency and the radiation reactance of water within the range F1–F2 and $C_m$ is the compliance of the actuators.

9. An underwater sound projector as set forth in claim 8 wherein said actuators are distributed essentially uniformly over the panels so that each stack drives and essentially equal area of the panel and there is essentially no flexing of the panel.

10. An underwater sound projector as set forth in claim 8 wherein the inertial component of the radiation impedance is substantially greater than the mass of the panels over the frequency range F1–F2.

11. An underwater sound projector as set forth in claim 8 wherein said actuators are piezoelectric stacks.

12. An underwater sound projector as set forth in claim 8 wherein said panels are constructed as honeycomb core plates.

13. An underwater sound projector as set forth in claim 8 wherein said panels are constructed of aluminum plate.

14. An underwater sound projector for radiating sound energy over a range of frequencies F1 to F2 into a body of water into which the projector is immersed, said projector comprising:

a pair of complementary, aligned and spaced-apart panels constructed of stiff, lightweight honeycomb cored plates;

means for flexibly sealing the peripheries of said panels to exclude water from the space between them;

a plurality of actuators between said panels for driving said panels in opposition, thereby to radiate sound energy into said body of water, the inertial component of the radiation impedance being substantially greater than the mass of the panels over the frequency range F1–F2, the compliance of the piezoelectric stacks being such that $$C_m\alpha=1$$

where $\alpha$ is the product of circular frequency and radiation reactance of water within the range F1–F2 and $C_m$ is the combined compliance of the actuators.

15. An underwater sound projector as set forth in claim 14 wherein the heights of said panels are about five times their widths.

16. An underwater sound projector for radiating sound energy over a range of frequencies F1 to F2 into a body of water into which the projector is immersed, said projector comprising:

a pair of complementary, aligned and spaced-apart panels constructed of stiff, aluminum plate which is divided into a plurality of equal area sections joined by relatively thin webs;

means for flexibly sealing the peripheries of said panels to exclude water from the space between them;

a plurality of actuators between said panels for driving said panels in opposition, there being three actuators driving each section, thereby to radiate sound energy into said body of water, the inertial component of the radiation impedance being substantially greater than the mass of the panels over the frequency range F1–F2, the compliance of the piezoelectric stacks being such that $$C_m\alpha=1$$

where $\alpha$ is the product of circular frequency and radiation reactance of water within the range F1–F2 and $C_m$ is the combined compliance of the actuators.

* * * * *